US006976663B1

(12) United States Patent
Faulk

(10) Patent No.: US 6,976,663 B1
(45) Date of Patent: Dec. 20, 2005

(54) NO TIP

(76) Inventor: Donnie L. Faulk, 1009 Via Jardin, PBG, FL (US) 33418

( * ) Notice: Subject to any disclaimer, the term of this patent is extended or adjusted under 35 U.S.C. 154(b) by 0 days.

(21) Appl. No.: 10/752,592

(22) Filed: Jan. 8, 2004

Related U.S. Application Data

(60) Provisional application No. 60/443,560, filed on Jan. 30, 2003.

(51) Int. Cl.[7] ..... A47G 29/00
(52) U.S. Cl. ..... 248/688
(58) Field of Search ..... 248/351, 354.1, 248/345.3, 688, 909; 52/149, 127.2, 36.4, 52/98, 100

(56) References Cited

U.S. PATENT DOCUMENTS 1,766,092 A 6/1930 Bailey ..... 297/310
4,009,904 A 3/1977 Sheldon ..... 297/217
4,304,078 A * 12/1981 Meriwether, Jr. ..... 52/127.2
4,566,517 A * 1/1986 Simon ..... 160/263
5,137,295 A 8/1992 Peek ..... 280/304.1
5,181,733 A 1/1993 Tague ..... 280/304
5,351,926 A * 10/1994 Moses ..... 248/354.5
5,653,415 A * 8/1997 Schworer ..... 248/354.1
5,697,742 A * 12/1997 House ..... 410/127
5,943,830 A * 8/1999 Truitt ..... 52/127.2
6,776,383 B2 * 8/2004 Lanka ..... 248/352

* cited by examiner

*Primary Examiner*—Hobert P. Olszewski
*Assistant Examiner*—A. Joseph Wujciak
(74) *Attorney, Agent, or Firm*—Patent & Trademark Services, Inc.; Joseph H. McGlynn

(57) ABSTRACT

A stabilizing device having two elements. One of the elements is secured to an object, and the other element is secured to the first element to prevent the object from tipping over.

7 Claims, 1 Drawing Sheet

NO TIP

Applicant claims priority of Provisional application Ser. No. 60/443,560, filed Jan. 30, 2003.

BACKGROUND OF THE INVENTION

This invention relates, in general, to an anti-tip device, and, in particular, to an anti-tip device that attaches to an object.

DESCRIPTION OF THE PRIOR ART

In the prior art, various types of devices, which prevent an object from tipping over, have been proposed. For example, U.S. Pat. No. 1,766,092 to Bailey discloses a support for chairs and stands having a pair of support legs that pivot out from the top of the chair and engages the floor at the bottom of the chair.

U.S. Pat. No. 5,137,295 to Peek discloses a support for a wheelchair having a pivotal back member that pivots when the arm rest is raised. U.S. Pat. No. 5,181,733 to Tague discloses a support for a wheelchair having a bar attached near the bottom of the chair that rotates into a supporting position.

U.S. Pat. No. 4,009,904 to Sheldon discloses a safety leg for a high chair having two ends wherein the first end attaches to a table and the other end attaches to a wall.

In contrast to these prior art references, and the known prior art, the present invention prevents an object from tipping over. The present invention preferably comprises two elements wherein the first element has a plurality of surfaces and has a predetermined thickness and perimeter, and a mounting bracket is attached to its first surface. The second element has a plurality of surfaces and a second predetermined thickness and a shaft is attached to its first surface. The shaft attached to the second element couples with the mounting bracket of the first element and the first element attaches to an object and the combination of the first and second elements prevent the object from tipping over. A pin is releasably attached to both the shaft and mounting bracket to couple the first element to the second element.

SUMMARY OF THE INVENTION

The present invention prevents an object from tipping over. The present invention preferably comprises two elements wherein the first element has a plurality of surfaces with a predetermined thickness and perimeter and a mounting bracket is attached to a first surface. The second element has a plurality of surfaces and a second predetermined thickness, and a shaft is attached to the first surface. The shaft attached to the second element couples with the mounting bracket of the first element, whereby the first element attaches to an object and the combination of the first and second elements prevent the object from tipping over. A pin is releasably attached to both the shaft and mounting bracket to couple the first element to the second element.

It is an object of the present invention to provide a new and improved device to prevent an object from tipping over.

It is an object of the present invention to provide a new and improved device to prevent an object from tipping over that is attached to an object.

These and other objects and advantages of the present invention will be fully apparent from the following description, when taken in connection with the annexed drawings.

BRIEF DESCRIPTION OF THE DRAWINGS

The above and other advantages and features of the present invention will be better understood from the following detailed description of the preferred embodiments of the present invention, which is provided in connection with the accompanying drawings. The various features of the drawings may not be to scale. Included in the drawing are the following figures.

DESCRIPTION OF THE PREFERRED EMBODIMENT

When feeding an infant or a small child, typically the infant or small child is placed in a high chair. Since high chairs typically have a narrow base and are often relatively tall in height, the infant or small child can rock, tilt or shift causing the chair to tilt and fall over. Additionally, people may place valuables on a table and if the table should tip over, the valuables can be damaged. It is, therefore, a purpose of the present invention to prevent an object from tipping over.

Figure 1:
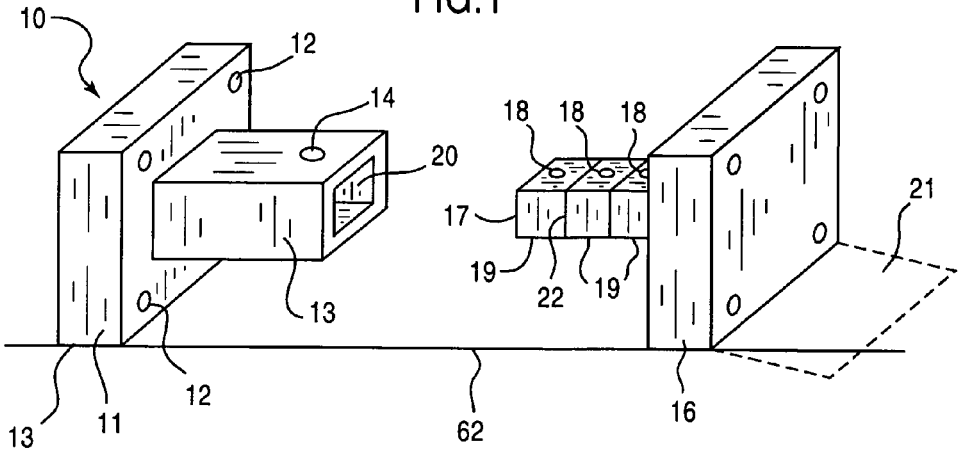
FIG. 1 is a perspective view of the first and second element of the present invention.

Referring to the drawings in greater detail, FIG. 1 shows the present invention 10 having a first element 11 and a second element 16. It should be understood that the present invention 10, as shown in FIG. 1, is merely for illustration purposes only and should not be considered its only shape or form. For example, both the first and second elements 11 and 16 are shown as being substantially rectangular in shape, but either element 11, element 16 or both elements 11 and 16 can be any shape well known within the art such as a circle, pentagon, or the like.

Figure 2:
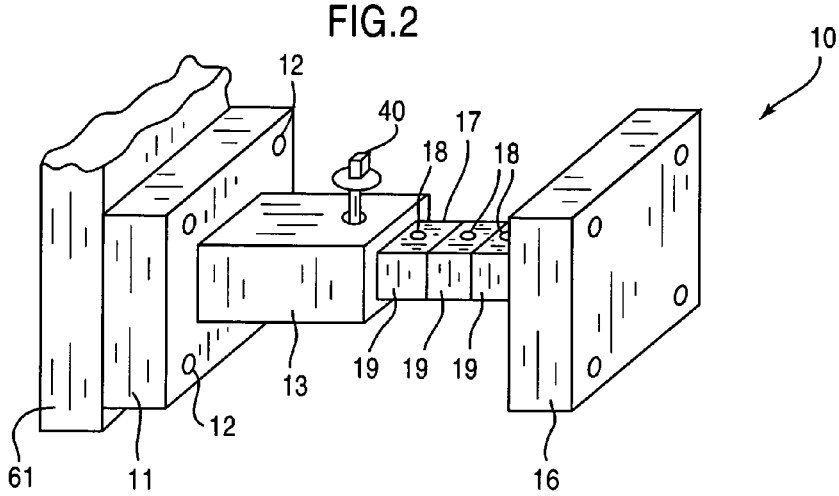
FIG. 2 is a perspective view of the present invention coupled together.

As shown in FIG. 1, element 11 is preferably rectangular in shape and has a plurality of surfaces. Within the element 11 is at least one hole 12 that extends through the element. Hole 12 enables the element 11 to be attached to an object by any conventional means. For example, a user can place a threaded object such as a screw through hole 12 to threadedly couple the element 11 to an object 61, as shown in FIG. 2. Nails could be substituted for the screw, or tape or glue can be placed on element 11 to couple the element 11 to an object.

Since element 11 can be attached to a variety of objects, the bottom, B, of the element 11 may not be flat, as shown in FIG. 1. The bottom, B, of the element 11 can be any shape that will allow the bottom of the first element to be flush with the surface it rests on. For example, a strip of foam or the like can be attached to the bottom B of element 11 to ensure that the element 11 rests firmly on the surface 62.

Mounting bracket 13 is attached to element 11 by any conventional means. The mounting bracket 13 can be attached anywhere on a surface of element 11. Also, element 11 and mounting bracket 13 can be made of a one-piece, unitary construction. The mounting bracket 13 is an elongated, hollow member having two ends, one of which is secured to a surface of element 11. The other end of the mounting bracket 13 has at least one aperture 14 extending through the top surface of bracket 13. While the mounting bracket 13 is shown in FIG. 1 as substantially rectangular in shape, it is to be understood that mounting bracket 13 can be any shape.

Element 11 and mounting bracket 13 can be made of any conventional material such as plastic, metal, rubber, or the like, and can be manufactured in a variety of colors, textures or patterns to substantially match the color, texture or pattern of the object to which they are attached. Additionally, at least a portion of the width of the element 11 can be rubberized to create a non-slip surface.

The second element 16 is preferably rectangular in shape. A shaft 17 is attached to a surface of the element 16 by any conventional means. Shaft 17 is an elongated member having two ends. Also, element 16 and shaft 17 can be of one-piece, unitary construction. The outside dimension of shaft 17 is substantially the same as the size of the opening 20 in bracket 13, thereby allowing shaft 17 to fit within the mounting bracket 13 creating a male-female connection between shaft 17 and mounting bracket 13.

The shaft 17 features a plurality of sections 19. Each section 19 is separated from an adjacent section 19 by a score line 22. The score line will allow the sections 19 to be broken off to adjust the length of shaft 17. In addition, there are a plurality of apertures 18 spaced along the length of shaft 17.

Element 16 and shaft 17 can be made of any conventional material such as plastic, metal, rubber, or the like, and can be manufactured in a variety of colors, textures or patterns. Additionally, at least a portion of element 16 can be rubberized creating a non-slip surface.

As shown in FIG. 1, a flange 21 is attached to element 16 by any conventional means. Flange 21 and element 26 could also be made of one-piece, unitary construction. Flange 21 provides greater stability to the present invention 10. The bottom of flange 21 can be rubberized thereby creating a non-slip, non-skid surface.

FIG. 2 shows the present invention 10 when elements 11 and 16 are coupled to each other. As described above, shaft 17 and opening 20 of mounting bracket 13 are about the same size and shape thereby allowing shaft 17 to fit within the hollow opening of the mounting bracket 13. Shaft 17 features score lines 22 enabling the user to adjust the length of shaft 17 by snapping off one or more sections 19. At least apertures 18 should be threaded. Once the shaft 17 is inserted into aperture 20, and aperture 14 is aligned with one of the apertures 18, screw pin 40 (shown in FIG. 3) is inserted into holes 14 and 18 thereby ensuring that elements 11 and 16 are releasably attached to each other.

Figure 3:
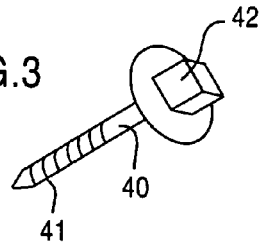
FIG. 3 is a perspective view of the screw pin of the present invention.

FIG. 3 is a detailed view of the screw pin 40. Screw pin 40 is an elongated member having two ends wherein the first end has a plurality of screw threads 41. Attached to the second end is a protrusion 42. When the user inserts screw pin 40 into hole 14 of the mounting bracket 13 and one of the holes 18 on shaft 17 and rotates pin 40 by the protrusion 42, the screw pin 40 will be threadedly attached to shaft 17. thereby securing elements 11 and 16 together.

When the present invention 10 is secured to an object such as object 61 in FIG. 2, the object will be stabilized. The object 61 can be a chair, table or the like. Any force applied to the object 61 (resting on a surface 62) in the direction of elements 11 and 16 will not tip over the object since elements 11, 16 will provide stability to the object. Of course additional elements 11, 16 can be attached in different areas of the object to prevent a force from any direction from tipping over the object.

Although the present invention and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. A device which is adapted to prevent objects from tipping over, said device comprising:

a first element, said first element having a first surface and a second surface, a mounting bracket secured to one of said first and second surface, and means for attaching said first element to an object, a second element, said second element having a first surface and a second surface, a shaft secured to said first surface of said second element, and means for securing said shaft to said mounting bracket, and wherein said shaft has a length, and means for adjusting said length, and wherein said means for adjusting said length of said shaft comprises said shaft being made in a plurality of adjacent sections, and each adjacent section being separated from another adjacent section by a score line, and a second means for adjusting the length of said shaft, said second means comprising:

said mounting bracket has an aperture extending through a top surface of said mounting bracket, and said shaft has a plurality of apertures extending along said length, and one of said plurality of apertures, extending along said length of said shaft, aligns with said aperture extending through said top surface of said mounting bracket when said shaft is inserted into said mounting bracket, and means, engaging said one of said plurality of apertures and said aperture extending through said top surface of said mounting bracket, for securing said mounting bracket and said shaft together.

2. The device as claimed in claim 1, wherein said mounting bracket has a top surface and a bottom surface, and an end surface extending from said top surface to said bottom surface, an aperture extending into said end surface, and a second aperture extending through said top surface.

3. The device as claimed in claim 1, wherein said shaft has a length and a plurality of apertures extending along said length.

4. The device as claimed in claim 1, wherein said mounting bracket has a top surface and a bottom surface, and an end surface extending from said top surface to said bottom surface, an aperture extending into said end surface, and said aperture has an inside dimension, and said shaft has an outside dimension, and said shaft outside dimension fits into said aperture inside dimension.

5. The device as claimed in claim 4, wherein said means for securing said mounting bracket and said shaft together comprises a shaft, said shaft having a first end and a second end, and said first end has a projection extending therefrom, and said second end has screw threads.

6. The device as claimed in claim 1, wherein said second element has a stabilizing means for stabilizing said second element.

7. The device as claimed in claim 6, wherein said stabilizing means extends from said second surface of said second element.

* * * * *